US011811162B2

(12) United States Patent
Hong et al.

(10) Patent No.: US 11,811,162 B2
(45) Date of Patent: Nov. 7, 2023

(54) ELECTRICAL CONNECTOR, ELECTRICAL MATING CONNECTOR, AND ELECTRICAL CONNECTOR ASSEMBLY

(71) Applicant: Dongguan Luxshare Technologies Co., Ltd, Dongguan (CN)

(72) Inventors: Bing-Nan Hong, Taipei (TW); Yung-Chih Hung, Taipei (TW)

(73) Assignee: DONGGUAN LUXSHARE TECHNOLOGIES CO., LTD, Dongguan (CN)

( * ) Notice: Subject to any disclaimer, the term of this patent is extended or adjusted under 35 U.S.C. 154(b) by 50 days.

(21) Appl. No.: 17/466,817

(22) Filed: Sep. 3, 2021

(65) Prior Publication Data

US 2022/0102903 A1 Mar. 31, 2022

(30) Foreign Application Priority Data

Sep. 25, 2020 (CN) ..... 202011024296.2

(51) Int. Cl.
*H01R 13/514* (2006.01)
*H01R 13/24* (2006.01)
*H01R 13/629* (2006.01)
*H01R 27/02* (2006.01)

(52) U.S. Cl.
CPC ..... *H01R 13/514* (2013.01); *H01R 13/2407* (2013.01); *H01R 13/629* (2013.01); *H01R 27/02* (2013.01)

(58) Field of Classification Search
CPC .. H01R 13/055; H01R 13/057; H01R 13/514; H01R 13/2407; H01R 13/629; H01R 27/02
USPC ..... 439/825, 887
See application file for complete search history.

(56) References Cited

U.S. PATENT DOCUMENTS 3,588,789 A * 6/1971 Name not available ..... H01R 13/02 439/825
4,416,504 A * 11/1983 Sochor ..... H01R 13/05 439/825
7,766,664 B2 * 8/2010 Cheng ..... H01R 12/7088 439/825
10,177,487 B2 1/2019 Chen et al.
(Continued)

FOREIGN PATENT DOCUMENTS

TW I657628 B 4/2019

*Primary Examiner* — Gary F Paumen
(74) *Attorney, Agent, or Firm* — Birch, Stewart, Kolasch & Birch, LLP

(57) ABSTRACT

The present disclosure provides an electrical connector, and electrical mating connector, and an electrical mating connector. The electrical connector comprises a housing and a terminal member. The terminal member is disposed in the housing. The terminal member comprises a first terminal and a second terminal opposite to the first terminal. The first terminal comprises a first bump part and a first notch part, and the first bump part is disposed on one side of the first notch part. The second terminal comprises a second bump part and a second notch part, and the second bump part is disposed on one side of the second notch part. The first bump part is opposite to the second notch part, and the second bump is opposite to the first notch part. The electrical connector is plugged into the electrical mating connector to form an electrical connector assembly.

11 Claims, 7 Drawing Sheets

(56) References Cited

U.S. PATENT DOCUMENTS

| | | | | |
|---|---|---|---|---|
| 2002/0098743 | A1* | 7/2002 | Schell | H01R 12/7088<br>439/850 |
| 2015/0133005 | A1* | 5/2015 | Saka | C25D 7/00<br>439/887 |
| 2017/0214165 | A1* | 7/2017 | Brungard | H01R 13/10 |

* cited by examiner

ELECTRICAL CONNECTOR, ELECTRICAL MATING CONNECTOR, AND ELECTRICAL CONNECTOR ASSEMBLY

CROSS-REFERENCE TO RELATED APPLICATION

This application claims the priority benefit of Chinese Patent Application Serial Number 202011024296.2, filed on Sep. 25, 2020, the full disclosure of which is incorporated herein by reference.

BACKGROUND

Technical Field

The present disclosure relates to the technical field of electrical connector, particularly to an electrical connector, electrical mating connector, and electrical connector assembly.

Related Art

In the prior arts, electrical connectors mainly comprise a housing and a terminal, wherein the housing and the terminal are regulated in a fixed standard size. When the terminal is assembled with the housing, the structural dimensions of the terminal and the housing are relatively fixed. However, when an electrical connector is assembled onto another electrical connector, the terminal of the electrical connector needs to be inserted into the terminal of another electrical connector, allowing the terminal of the electrical connector to be electrically connected with the terminal of another electrical connector and to be interfered by the terminal of another electrical connector. Thus, one end of the terminal of the electrical connector is prone to be compressed and deformed.

SUMMARY

The embodiments of the present disclosure provide an electrical connector, an electrical mating connector, and an electrical connector assembly tended to solve the problem that the terminals of electrical connectors are prone to be interfered and deformed.

On the first aspect, the present disclosure provides an electrical connector comprising a housing and a terminal member. The terminal member is disposed in the housing and comprises a first terminal and a second terminal opposite to the first terminal. The first terminal comprises a first bump part and a first notch part. The first bump part is disposed at one side of the first notch part. The second terminal comprises a second bump part and a second notch part. The second bump part is disposed at one side of the second notch part. The first bump part is opposite to the second notch part. The second bump part is opposite to the first notch part.

On the second aspect, the present disclosure provides an electrical mating connector comprising a mating housing and a terminal component. The terminal component is disposed in the mating housing and comprises a first terminal and a second terminal opposite to the first terminal. A surface of the first terminal and a surface of the second terminal oppositely disposed are anti-friction surfaces.

On the third aspect, the present disclosure provides an electrical connector assembly comprising an electrical connector according to the first aspect and an electrical mating connector according to the second aspect. The electrical mating connector is inserted in the electrical connector. The terminal member of the electrical connector is electrically connected to the terminal component of the electrical mating connector. Wherein one ends of a plurality of first elastic pieces and one ends of a plurality of second elastic pieces respectively abut against the anti-friction surface.

In the embodiments of the present disclosure, the terminal member of the electrical connector comprises a first terminal and a second terminal opposite to the first terminal. The first terminal comprises a first bump part and a first notch part, and the second terminal comprises a second bump part and a second notch part. The first bump part is opposite to the second notch part, and the second bump part is opposite to the first notch part. The electrical connector is plugged into the electrical mating connector to form an electrical connector assembly. When the first elastic piece and the second elastic piece of the electrical connector are compressed by the electrical mating connector, a bump part of the first elastic piece is disposed in the notch part of the second elastic piece, and a bump part of the second elastic piece is disposed in the notch part of the first elastic piece. In the electrical connector assembly of the present disclosure, mutual interference between the elastic pieces leading to deformation of elastic pieces can be avoided through the correspondence between the bump parts and the notch parts.

It should be understood, however, that this summary may not contain all aspects and embodiments of the present disclosure, that this summary is not meant to be limiting or restrictive in any manner, and that the disclosure as disclosed herein will be understood by one of ordinary skill in the art to encompass obvious improvements and modifications thereto.

BRIEF DESCRIPTION OF THE DRAWINGS

The features of the exemplary embodiments believed to be novel and the elements and/or the steps characteristic of the exemplary embodiments are set forth with particularity in the appended claims. The Figures are for illustration purposes only and are not drawn to scale. The exemplary embodiments, both as to organization and method of operation, may best be understood by reference to the detailed description which follows taken in conjunction with the accompanying drawings in which:

DETAILED DESCRIPTION OF THE EMBODIMENTS

The present disclosure will now be described more fully hereinafter with reference to the accompanying drawings, in which exemplary embodiments of the disclosure are shown. This present disclosure may, however, be embodied in many different forms and should not be construed as limited to the embodiments set forth herein. Rather, these embodiments are provided so that this present disclosure will be thorough and complete, and will fully convey the scope of the present disclosure to those skilled in the art.

Certain terms are used throughout the description and following claims to refer to particular components. As one skilled in the art will appreciate, manufacturers may refer to a component by different names. This document does not intend to distinguish between components that differ in name but function. In the following description and in the claims, the terms "include/including" and "comprise/comprising" are used in an open-ended fashion, and thus should be interpreted as "including but not limited to". "Substantial/substantially" means, within an acceptable error range, the person skilled in the art may solve the technical problem in a certain error range to achieve the basic technical effect.

The following description is of the best-contemplated mode of carrying out the disclosure. This description is made for the purpose of illustration of the general principles of the disclosure and should not be taken in a limiting sense. The scope of the disclosure is best determined by reference to the appended claims.

Moreover, the terms "include", "contain", and any variation thereof are intended to cover a non-exclusive inclusion. Therefore, a process, method, object, or device that includes a series of elements not only includes these elements, but also includes other elements not specified expressly, or may include inherent elements of the process, method, object, or device. If no more limitations are made, an element limited by "include a/an . . . " does not exclude other same elements existing in the process, the method, the article, or the device which includes the element.

Figure 1:
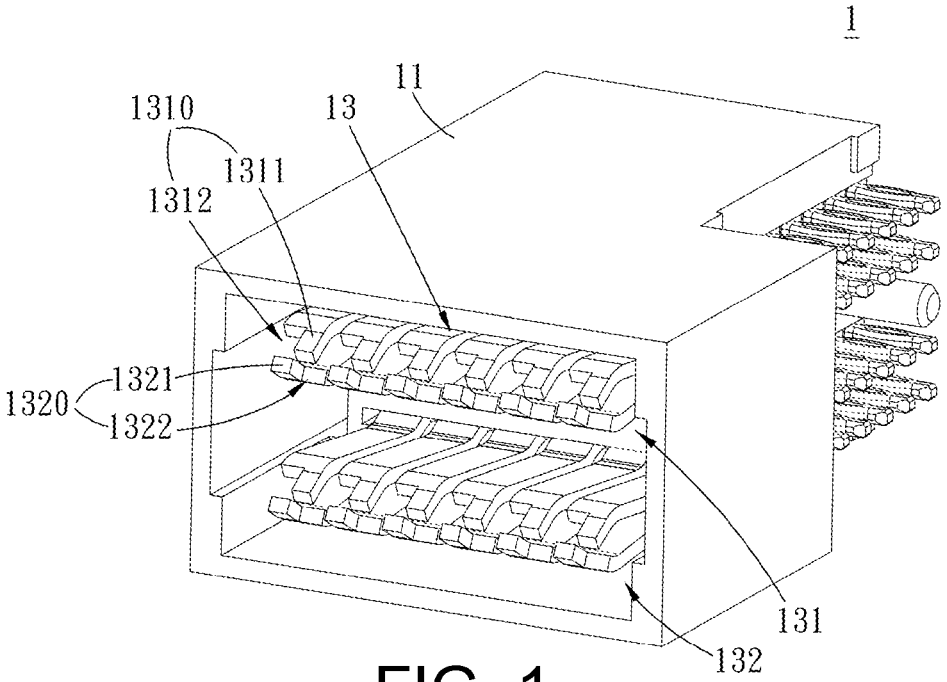
FIG. 1 is a perspective view of an electrical connector of the present disclosure.
Figure 2:
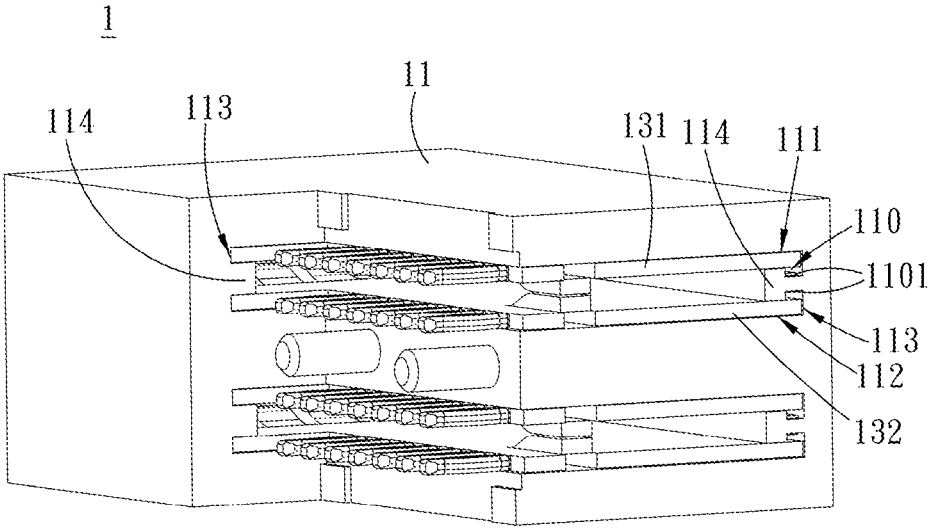
FIG. 2 is another perspective view of the electrical connector of the present disclosure.

FIG. 1 and FIG. 2 are perspective views of an electrical connector of the present disclosure. As shown in the figures, this embodiment provides an electrical connector 1 comprising a housing 11 and a terminal member 13. The terminal member 13 is disposed in the housing 11, and comprises a first terminal 131 and a second terminal 132 opposite to the first terminal 131. The first terminal 131 comprises a first bump part 1311 and a first notch part 1312. The first bump part 1311 is disposed at one side of the first notch part 1312. The second terminal 132 comprises a second bump part 1321 and a second notch part 1322. The second bump part 1321 is disposed at one side of the second notch part 1322. The first bump part 1311 is opposite to the second notch part 1322. The second bump part 1321 is opposite to the first notch part 1312.

The geometric shape of the first bump part 1311 is complementary to the shape of the second notch part 1322. The geometric shape of the second bump part 1321 is complementary to the shape of the first notch part 1312. When one end of the first terminal 131 comprising the first bump part 1311 and the first notch part 1312 is close to one end of the second terminal 132 comprising the second bump part 1311 and the first notch part 1312, the first bump part 1311 would be disposed in the second notch part 1322, and the second bump part 1321 would be disposed in the first notch part 1312. In this way, the mutual interference between one end of the first terminal 131 and one end of the second terminal 132 can be avoided. Since the geometry shape of the bump part is not limited in this embodiment, the bump part can be circular, triangular, or rectangular, and the notch of the notch part can be circular, triangular, or rectangular correspondingly.

Besides, the geometric shape of the bump part can be uncomplimentary to the shape of the notch part. In this embodiment, the first bump part 1311 in a geometry shape can be accommodated in the second notch part 1322 due to the notch shape, and the second bump part 1321 in a geometry shape can be accommodated in the first notch part 1312 due to the notch shape. The mutual inference and influence between one end of the first terminal 131 and one end of the second terminal 132 can also be avoided by the configuration above. In this embodiment, the first terminal 131 and the second terminal 132 are oppositely disposed and are respectively disposed in the housing 11. Besides, the terminal member 13 of the present disclosure could also comprise a terminal body (not shown). The first terminal 131 and the second terminal 132 respectively extend from one side of the terminal body. The terminal body, the first terminal 131, and the second terminal 132 are integrally formed to one piece, i.e., one terminal, to effectively reduce the size of the terminal member 13. The terminal member 13 of the present disclosure can be modified according to user requirements and can be implemented by applying the configuration of the bump part and the notch part corresponding to the bump part of a terminal.

Figure 3:
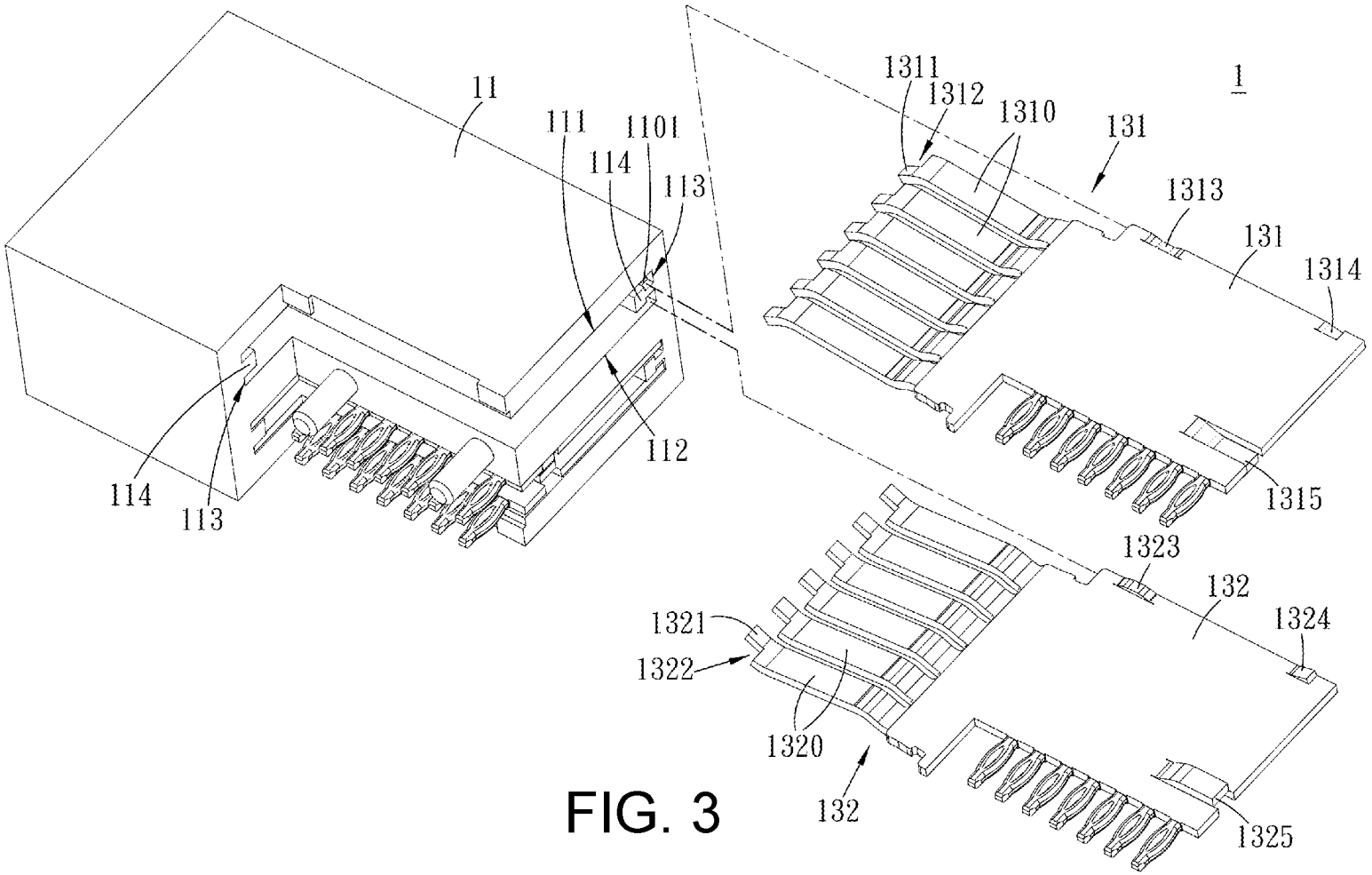
FIG. 3 is an exploded view of the electrical connector of the present disclosure.

FIG. 3 is an exploded view of the electrical connector of the present disclosure. As shown in the figure, in this embodiment, the first terminal 131 and the second terminal 132 in the housing 11 are respectively disposed in the housing 11. The first terminal 131 comprises a plurality of first elastic pieces 1310. One end of each of the first elastic pieces 1310 comprises the first bump part 1311 and the first notch part 1312. The plurality of first elastic pieces 1310 are disposed at intervals. the second terminal 132 comprises a plurality of second elastic pieces 1320. One end of each of the second elastic pieces 1320 comprises the second bump part 1321 and the second notch part 1322. The plurality of second elastic pieces 1320 are arranged corresponding to the plurality of first elastic pieces 1310. That is, the plurality of second elastic pieces 1320 are disposed at intervals.

In this embodiment, the electrical connector 1 is a bend male connector. The housing 11 of the electrical connector 1 comprises two communicating holes. Each of the communicating holes penetrates the housing 11. The opening on one end of the housing 11 is presented in rectangular while on the other end is L-shaped, and one end of the communicating hole communicates with the rectangular opening while the other end communicates with the L-shaped r opening. The terminal member 13 can be disposed in the communicating hole through the L-shaped opening. The plurality of first elastic pieces 1310 and the plurality of second elastic pieces 1320 of the terminal member 13 are exposed from the rectangular opening. The terminal member 13 further comprises a fisheye terminal exposed from the L-shaped opening.

Furthermore, the housing 11 comprises a first inner wall 111, a second inner wall 112, and two inner sidewalls 113. The first inner wall 111 is opposite to the second inner wall 112. The two inner sidewalls 113 are respectively connected with a side edge of the first inner wall 111 and a side edge of the second inner wall 112. The housing 11 further comprises two ribs 114 disposed on the two inner sidewalls 113. One of the two ribs 114 faces a guiding groove 110 respectively provided on the first inner wall 111 and the second inner wall 112. The two guiding grooves 110 are oppositely disposed. The first terminal 131 comprises a first guiding part 1313, and the second terminal 132 comprises a second guiding part 1323. The first guiding part 1313 of the first terminal 131 is disposed along the corresponding guiding groove 110 to be disposed in the housing 11, so that the first terminal 131 can be parallel to the first inner wall 111. The second guiding part 1323 of the second terminal 132 is disposed along the corresponding guiding groove 110 to be disposed in the housing 11, so that the second terminal 132 can be parallel to the second inner wall 112. The first terminal 131 is opposite to the second terminal 132.

The opening of the guiding groove 110 comprises a guiding oblique opening 1101. The first guiding part 1313 of the first terminal 131 and the second guiding part 1323 of the second terminal 132 are disposed in the guiding groove 110 through the guiding oblique opening 1101. In this embodiment, the first terminal 131 and the second terminal 132 can be easily assembled in the housing 11 through the guiding oblique opening 1101. The first terminal 131 comprises a first abutting part 1314. The second terminal 132 comprises a second abutting part 1324. The first abutting part 1314 and the second abutting part 1324 are disposed along and abut against the opposite guiding grooves 110. In this way, the first terminal 131 could move along the guiding groove 110 under the assistant of the first abutting part 1314, and could be stabilized by the first abutting part 1314 to parallelly attach to the first inner wall 111; the second terminal 132 could move along the guiding groove 110 under the assistant of the second abutting part 1324 and could be stabilized by the second abutting part 1324 to parallelly attach to the second inner wall 112.

Besides, the first terminal 131 comprises a first interfering part 1315. The second terminal 132 comprises a second interfering part 1325. The first interfering part 1315 abuts against the second interfering part 1325. In this way, the first terminal 131 and the second terminal 132 can be stably disposed in the housing 11 at intervals, so that the fisheye terminal of the first terminal 131 and the fisheye terminal of the second terminal 132 would not be mutually compressed and thereby would not be deformed.

Figure 4:
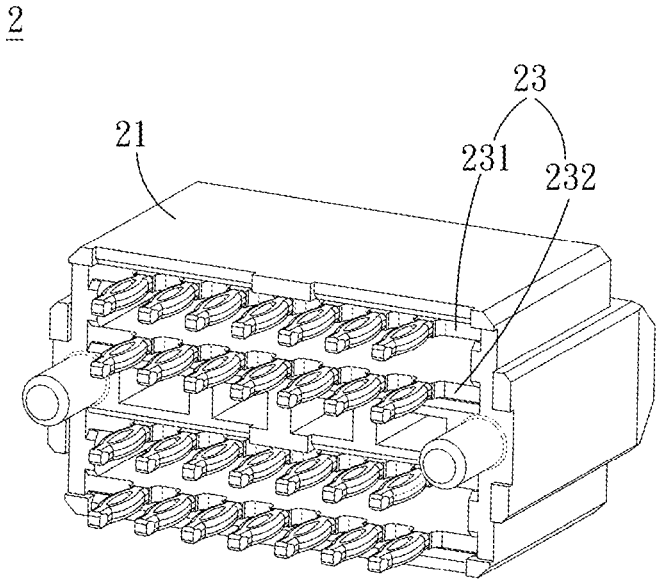
FIG. 4 is a perspective view of an electrical mating connector of the present disclosure.
Figure 5:
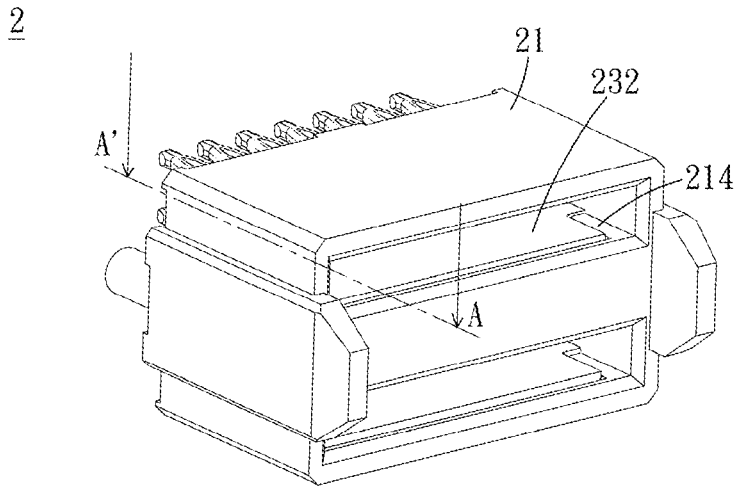
FIG. 5 is another perspective view of the electrical mating connector of the present disclosure.
Figure 6:
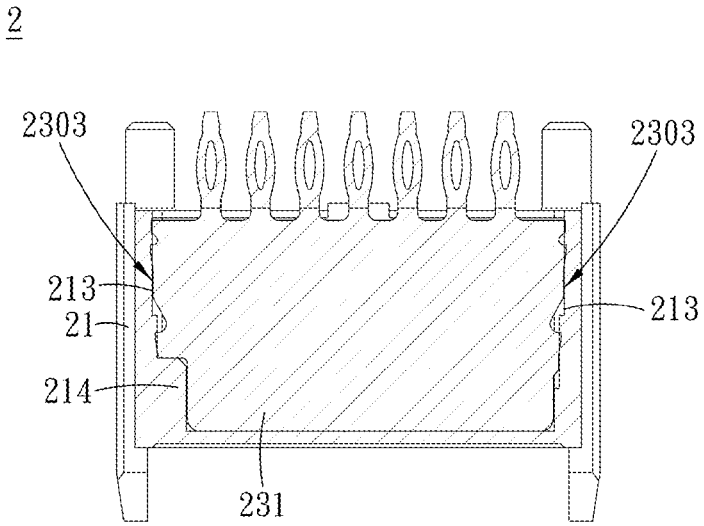
FIG. 6 is a cross-sectional view along line A-A' of FIG. 5.
Figure 7:
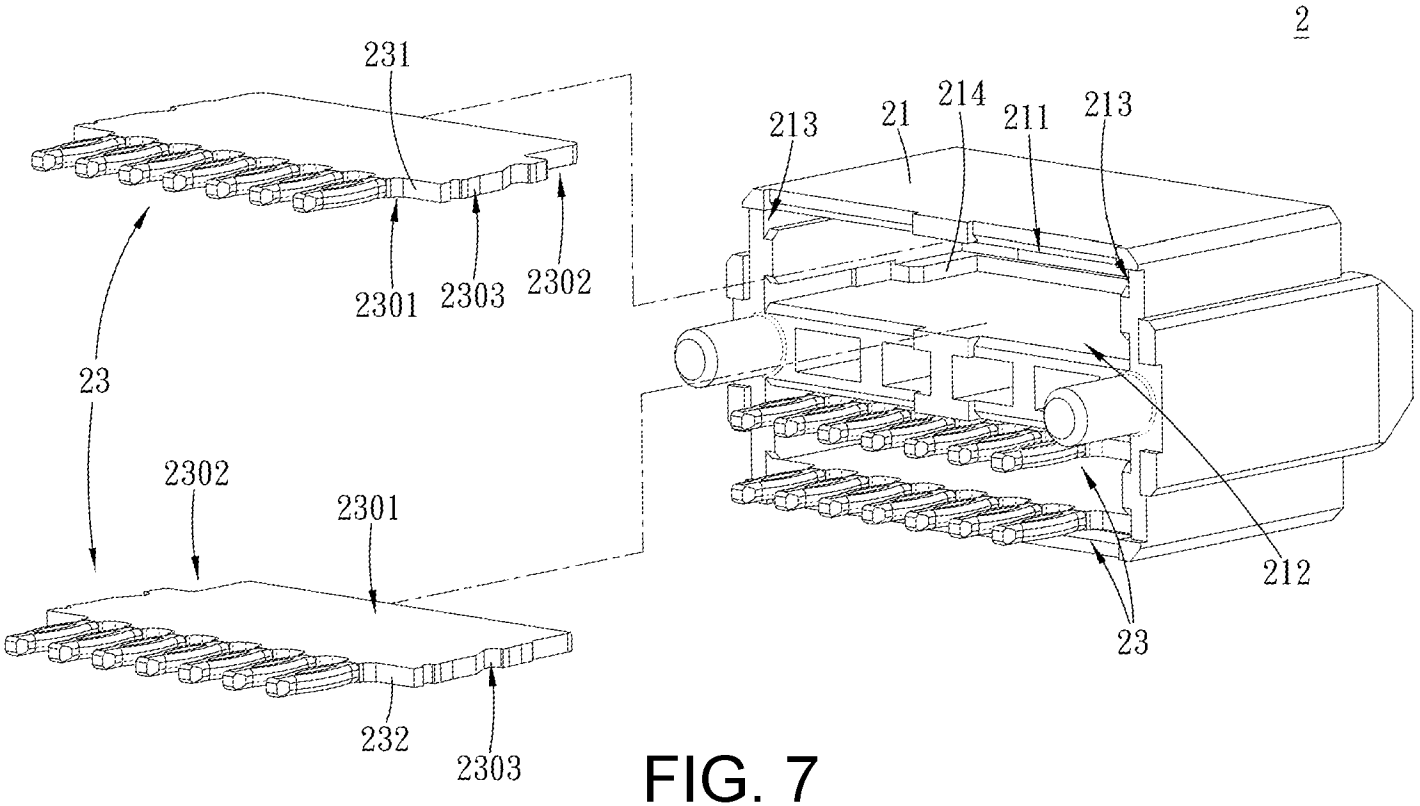
FIG. 7 is an exploded view of the electrical mating connector of the present disclosure.

FIG. 4 and FIG. 5 are perspective views of an electrical mating connector of the present disclosure. FIG. 6 is a cross-sectional view along line A-A' of FIG. 5. FIG. 7 is an exploded view of the electrical mating connector of the present disclosure. As shown in the figures, in this embodiment, an electrical mating connector 2 is provided, which comprises a mating housing 21 and a terminal component 23. The terminal component 23 is disposed in the mating housing 21 and comprises a first terminal 231 and a second terminal 232 opposite to the first terminal 231. A surface of the first terminal and a surface of the second terminal oppositely disposed are anti-friction surfaces 2301. The anti-friction surfaces 2301 protects the electrical contacting surface of the first terminal 231 and the second terminal 232 from being frictionally damaged. When the electrical connector 1 is inserted into the electrical mating connector 2, the terminal member 13 of the electrical connector 1 would abut against the anti-friction surface 2301 on the outside of the electrical contacting surface of the terminal component 23 of the electrical mating connector 2. Thus, except from being used for electrical connection, the anti-friction surface 2301 could also reduce the wearing of the terminal member 13 of the electrical connector 1 when inserted into the terminal component 23 of the electrical mating connector 2. The anti-friction surface 2301 can be gold-plated, silver-plated, or copper-plated, etc.

In this embodiment, the electrical mating connector 2 is a straight female connector. The mating housing 21 of the electrical mating connector 2 comprises two communicating holes, and each of the communicating holes penetrates the mating housing 21. Two ends of the mating housing 21 are rectangular openings, and two ends of the communicating hole communicate with the rectangular openings. The terminal component 23 can be disposed in the communicating hole through the rectangular opening. The terminal component 23 further comprises a fisheye terminal exposed from the rectangular opening in which the terminal component 23 is disposed.

In this embodiment, since the anti-friction surface 2301 of the first terminal 231 or the second terminal 232 is only provided on a surface at one side of the first terminal 231 or the second terminal 232, a component is provided within the mating housing 21 to prevent the first terminal 231 and the second terminal 232 from being assembled in opposite direction to avoid incorrect assembly. A first inner wall 211, a second inner wall 212, and two inner sidewalls 213 are provided inside the mating housing 21. The first inner wall 211 is opposite to the second inner wall 212. The two inner sidewalls 213 are respectively connected with a side edge of the first inner wall 211 and a side edge of the second inner wall 212. Two bumps 214 are disposed inside the mating housing 21. The two bumps 214 are respectively disposed on the first inner wall 211 and the second inner wall 212. The two bumps 214 are diagonally disposed. The first terminal 231 and the second terminal 232 respectively comprise a notch 2302. The first terminal 231 and the second terminal 232 are disposed in the mating housing 21. The two notches 2302 are engaged with the two bumps 214. In this way, the anti-friction surface 2301 of the first terminal 231 is disposed on one side of the first terminal 231 away from the first inner wall 211 of the mating housing 21, and the anti-friction surface 2301 of the second terminal 232 is disposed on one side of the second terminal 232 away from the second inner wall 212 of the mating housing 21. Thus, the surfaces oppositely disposed on the first terminal 231 and on the second terminal 232 respectively are anti-friction surfaces 2301. The anti-friction surface 2301 of the first terminal 231 and the anti-friction surface 2301 of the second terminal 232 can be oppositely disposed in the plugging space of the mating housing 21 through the bumps 214.

Besides, two side edges of the first terminal 231 and two side edges of the second terminal 232 respectively comprise an interference part 2303. The first terminal 231 and the second terminal 232 are disposed in the mating housing 21. The interference part 2303 abuts against the two inner sidewalls 213. Thus, the first terminal 231 and the second terminal 232 can be secured in the mating housing 21.

Figure 8:
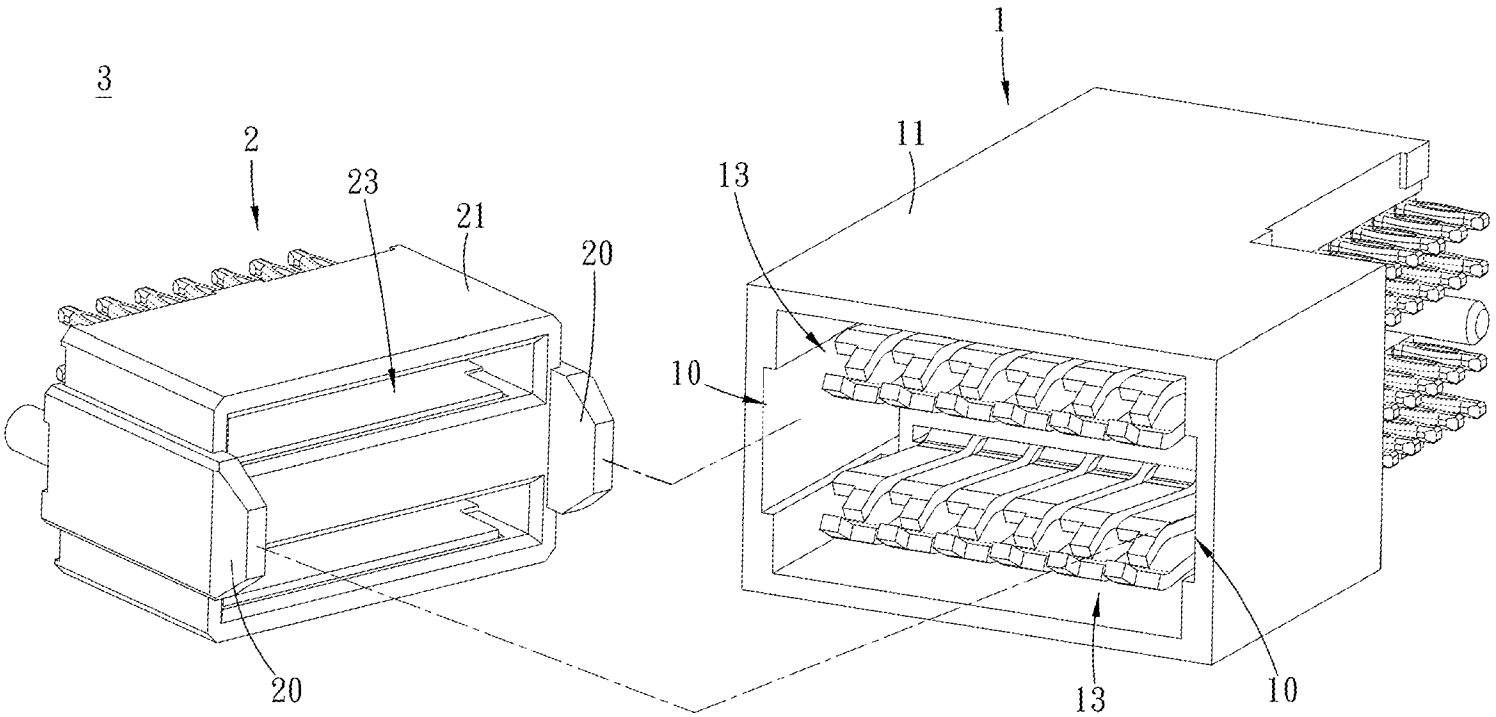
FIG. 8 is an exploded view of the connection between the electrical connector and the electrical mating connector of the present disclosure.
Figure 9:
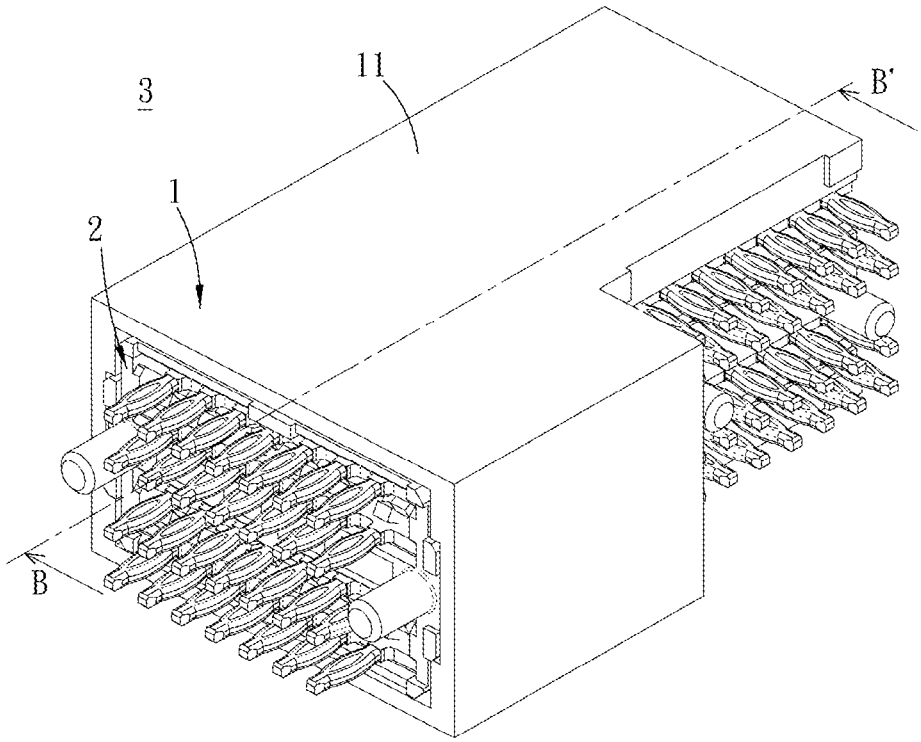
FIG. 9 is a perspective view of an electrical connector assembly of the present disclosure.
Figure 10:
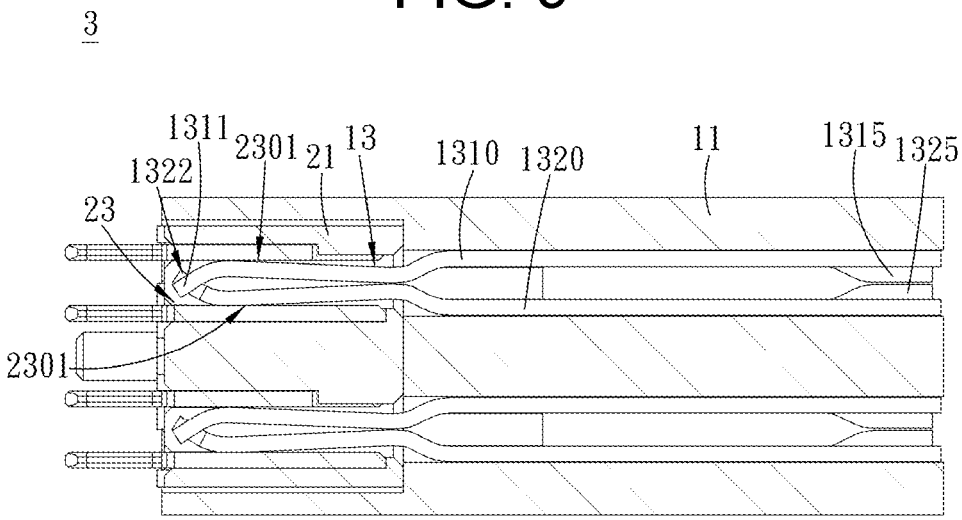
FIG. 10 is a cross-sectional view along line B-B' of FIG. 9.

FIG. 8 is an exploded view of the connection between the electrical connector and the electrical mating connector of the present disclosure. FIG. 9 is a perspective view of an electrical connector assembly of the present disclosure. FIG. 10 is a cross-sectional view along line B-B' of FIG. 9. As shown in the figures, this embodiment provides an electrical connector assembly 3 comprising an electrical connector 1 and an electrical mating connector 2. The electrical mating connector 2 is inserted in the electrical connector 1. A terminal member 13 of the electrical connector 1 is electrically connected to a terminal component 23 of the electrical mating connector 2. Wherein one end of a first elastic piece 1310 and one end of a second elastic piece 1320 of the terminal member 13 of the electrical connector 1 respectively abut against the anti-friction surface 2301 of the terminal component 23 of the electrical mating connector 2.

The housing 11 of the electrical connector 1 further comprises a plug guiding groove 10. The mating housing 21 of the electrical mating connector 2 comprises a plug guiding block 20. The plug guiding block 20 is plugged into the plug guiding groove 10 allowing the electrical connector 1 to be plugged into the electrical mating connector 2 without obstruction.

In this embodiment, the electrical mating connector 2 is plugged into the electrical connector 1 forming an electrical connector assembly 3. The terminal member 13 of the electrical connector 1 is inserted in the terminal component 23 of the electrical mating connector 2, i.e., the terminal member 13 of the electric connector 1 is disposed between the terminal components 23 of the electrical mating connector 2. The first elastic piece 1310 of the first terminal 131 of the terminal member 13 abuts against the anti-friction surface 2301 of the first terminal 231 of the terminal component 23, and the second elastic piece 1320 of the second terminal 132 of the terminal member 13 abuts against the anti-friction surface 2301 of the second terminal 232 of the terminal component 23.

Thus, the first elastic piece 1310 is compressed by the first terminal 231, and the second elastic piece 1320 is compressed by the second terminal 232. In this way, one end of the first elastic piece 1310 and one end of the second elastic piece 1320 are bent inward, and one end of the first elastic piece 1310 is interlaced with one end of the second elastic piece 1320. The bent first bump part 1311 of the first elastic piece 1310 is disposed in the second notch part 1322 of the second elastic piece 1320, and the bent second bump part 1321 of the second elastic piece 1320 is disposed in the first notch part 1312 of the first elastic piece 1310. In the electrical connector assembly 3 of this embodiment, mutual interference between the first elastic piece 1310 and the second elastic piece 1320 that causes the first elastic piece 1310 and the second elastic piece 1320 to deform can be avoided through the correspondence between the bump parts and the notch parts.

In summary, embodiments of the present disclosure provide an electrical connector, an electrical mating connector, and an electrical mating connector. The terminal member of the electrical connector comprises a first terminal and a second terminal opposite to the first terminal. The first terminal comprises a first bump part and a first notch part, and the second terminal comprises a second bump part and a second notch part. The first bump part is opposite to the second notch part, and the second bump is opposite to the first notch part. The electrical connector is plugged into the electrical mating connector to form an electrical connector assembly. When the first elastic piece and the second elastic piece of the electrical connector are compressed by the electrical mating connector, a bump part of the first elastic piece is disposed in the notch part of the second elastic piece, and a bump part of the second elastic piece is disposed in the notch part of the first elastic piece. In the electrical connector assembly of the present disclosure, mutual interference between the elastic pieces causing deformation of elastic pieces can be avoided through the correspondence between the bump parts and the notch parts.

It is to be understood that the term "comprises", "comprising", or any other variants thereof, is intended to encompass a non-exclusive inclusion, such that a process, method, article, or device of a series of elements not only comprise those elements but further comprises other elements that are not explicitly listed, or elements that are inherent to such a process, method, article, or device. An element defined by the phrase "comprising a . . . " does not exclude the presence of the same element in the process, method, article, or device that comprises the element.

Although the present disclosure has been explained in relation to its preferred embodiment, it does not intend to limit the present disclosure. It will be apparent to those skilled in the art having regard to this present disclosure that other modifications of the exemplary embodiments beyond those embodiments specifically described here may be made without departing from the spirit of the disclosure. Accordingly, such modifications are considered within the scope of the disclosure as limited solely by the appended claims.

What is claimed is:

1. An electrical connector, comprising:

a housing; and a terminal member disposed in the housing, comprising a first terminal and a second terminal opposite to the first terminal, the first terminal comprising a first bump part and a first notch part, the first bump part being disposed at one side of the first notch part, the second terminal comprising a second bump part and a second notch part, the second bump part being disposed at one side of the second notch part, the first bump part being opposite to the second notch part, the second bump part being opposite to the first notch part;

wherein the first terminal comprises a first guiding part; the second terminal comprises a second guiding part; a sidewall inside the housing is provided with two guiding grooves oppositely disposed; the first guiding part of the first terminal is assembled in the housing along the corresponding guiding groove; the second guiding part of the second terminal is assembled in the housing along the corresponding guiding groove;

wherein the housing comprises a first inner wall, a second inner wall, and two inner sidewalls; the first inner wall is opposite to the second inner wall; the two inner sidewalls are respectively connected with a side edge of the first inner wall and a side edge of the second inner wall; the housing further comprises two ribs disposed on the two inner sidewalls; one of the two ribs faces the guiding groove respectively provided on the first inner wall and the second inner wall; the first guiding part of the first terminal and the second guiding part of the second terminal are disposed along the opposite guiding grooves; the first terminal is opposite to the second terminal.

2. The electrical connector according to claim 1, wherein the geometric shape of the first bump part is complementary to the shape of the second notch part; the geometric shape of the second bump part is complementary to the shape of the first notch part.

3. The electrical connector according to claim 1, wherein the terminal member further comprises a terminal body; the first terminal and the second terminal extend from one side of the terminal body; the terminal body, the first terminal, and the second terminal are integrally formed to one piece.

4. The electrical connector according to claim 1, wherein the first terminal and the second terminal are opposite disposed; the first terminal and the second terminal are respectively assembled in the housing.

5. The electrical connector according to claim 3, wherein the first terminal comprises a plurality of first elastic pieces; one end of each of the first elastic pieces comprises the first bump part and the first notch part; the plurality of first elastic pieces are disposed at intervals; the second terminal comprises a plurality of second elastic pieces; one end of each of the second elastic pieces comprises the second bump part and the second notch part; the plurality of second elastic pieces are arranged corresponding to the plurality of first elastic pieces.

6. The electrical connector according to claim 1, wherein the opening of the guiding groove comprises a guiding oblique opening; the first guiding part of the first terminal and the second guiding part of the second terminal enter the guiding groove through the guiding oblique opening.

7. The electrical connector according to claim 1, wherein the first terminal comprises a first abutting part; the second terminal comprises a second abutting part; the first abutting part and the second abutting part are disposed along and abut against the opposite guiding grooves.

8. The electrical connector according to claim 4, wherein the first terminal comprises a first interfering part; the second terminal comprises a second interfering part; the first interfering part abuts against the second interfering part.

9. An electrical connector assembly, comprising:

an electrical connector, comprising:

a housing; and a terminal member disposed in the housing, comprising a first terminal and a second terminal opposite to the first terminal, the first terminal comprising a first bump part and a first notch part, the first bump part being disposed at one side of the first notch part, the second terminal comprising a second bump part and a second notch part, the second bump part being disposed at one side of the second notch part, the first bump part being opposite to the second notch part, the second bump part being opposite to the first notch part; and an electrical mating connector inserted in the electrical connector, comprising a mating housing and a terminal component disposed in the mating housing, the terminal component comprising a first terminal and a second terminal opposite to the first terminal, a surface of the first terminal and a surface of the second terminal oppositely disposed being anti-friction surfaces, the terminal member of the electrical connector being electrically connected to the terminal component of the electrical mating connector;

wherein one ends of the plurality of first elastic pieces and one ends of the plurality of second elastic pieces respectively abut against the anti-friction surfaces with an anti-friction material;

wherein the first terminal comprises a first guiding part; the second terminal comprises a second guiding part; a sidewall inside the housing is provided with two guiding grooves oppositely disposed; the first guiding part of the first terminal is assembled in the housing along the corresponding guiding groove; the second guiding part of the second terminal is assembled in the housing along the corresponding guiding groove;

wherein the housing comprises a first inner wall, a second inner wall, and two inner sidewalls; the first inner wall is opposite to the second inner wall; the two inner sidewalls are respectively connected with a side edge of the first inner wall and a side edge of the second inner wall; the housing further comprises two ribs disposed on the two inner sidewalls; one of the two ribs faces the guiding groove respectively provided on the first inner wall and the second inner wall; the first guiding part of the first terminal and the second guiding part of the second terminal are disposed along the opposite guiding grooves; the first terminal is opposite to the second terminal.

10. The electrical connector assembly according to claim 9, wherein the housing of the electrical connector further comprises a plug guiding groove; the mating housing of the electrical mating connector comprises a plug guiding block; the plug guiding block is plugged into the plug guiding groove.

11. The electrical connector assembly according to claim 9, wherein one end of the plurality of first elastic pieces and one end of the plurality of second elastic pieces are alternately arranged; wherein the first bump parts of the plurality of first elastic pieces are disposed in the second notch parts of the plurality of second elastic pieces; the second bump parts of the plurality of second elastic pieces are disposed in the first notch parts of the plurality of first elastic pieces.

* * * * *